United States Patent [19]

Divnick

[11] Patent Number: 4,762,512

[45] Date of Patent: Aug. 9, 1988

[54] COIN COLLECTOR

[75] Inventor: Stevan M. Divnick, Spring Valley, Ohio

[73] Assignee: Divnick International, Inc., Spring Valley, Ohio

[21] Appl. No.: 28,999

[22] Filed: Mar. 23, 1987

[51] Int. Cl.[4] ..... A63H 33/00

[52] U.S. Cl. ..... 446/8; 446/170; 273/113; D99/34; 206/0.8

[58] Field of Search ..... 446/8, 9, 10, 168, 170; 273/109, 113, 126 R; D99/34–36; D21/8, 12; 206/0.8, 0.82; 133/3 A

[56] References Cited

U.S. PATENT DOCUMENTS

| | | | |
|---|---|---|---|
| D. 171,192 | 12/1953 | Bower | D99/35 |
| D. 289,218 | 4/1987 | Divnick | D99/34 |
| 3,101,946 | 8/1963 | Ebert | 273/113 |
| 3,638,350 | 2/1972 | Wiggen | 446/168 |
| 3,738,658 | 6/1973 | Smith | 273/109 |

*Primary Examiner*—Mickey Yu

*Attorney, Agent, or Firm*—Biebel, French & Nauman

[57] ABSTRACT

A device for collecting and playing with coins or the like includes a base in the form of an upward and inward sloping hollow pedestal having a generally flat bottom and a circular upper end concentric with and of substantially lesser cross-sectional area than the bottom. An open top main body, having a vertically extending circular upper rim and a circular downwardly and inwardly formed surface portion, extends from said rim to a lower aperture concentric with the rim and merging with the upper end of the pedestal, whereby the main body is supported on the pedestal along a common vertical centerline. A launching ramp is removably mounted on the rim and curves upward and inward over the main body toward the vertical centerline. The ramp has a downwardly and outwardly formed guiding surface arranged to cause disc-like objects placed thereon to roll onto the surface of the main body inside the rim and through a helical path of decreasing radius through the aperture and into the base. The portion of the main body above the base is in the nature of a stem which can be grasped to maneuver the device.

5 Claims, 4 Drawing Sheets

COIN COLLECTOR

BACKGROUND OF THE INVENTION

This invention relates to a relatively lightweight portable device for collecting and also playing with small disc-like objects, particularly coins. The purpose of the device is to combine the features of a small or toy bank and a toy which uses one or more coins in games requiring manual dexterity and coordination.

Various prior devices are known for directing coins through some general form of conical surface into a collecting zone or box. Most of these relate to forms of fare boxes for mass transit vehicles, and are typified in U.S. Pat. No. 269,195 to Golding, Norwegian Pat. No. 64,495 to Flikkeid (1942), German Gebrauchmuster No. 2,507,963 (1975) , and published German application No. 1,137,884 (1962). U.S. Pat. No. 433,736 discloses a toy bank having a spiral ramp of several coils leading to a slot in the top of a drum-like base or container.

U.S. Pat. No. 3,092,928 discloses a toy for use with marbles, including an upper flat circular pan with a feed groove around its periphery leading to a tubular generally vertical track which discharges into a tangential extension of the top of an inverted conical base, so the marbles circle the base in decreasing circles an exit through a central bottom hole into a separate pan-like container. U.S. Pat. No. 3,559,990 discloses a form of bowling game including a large concave paraboloid shaped surface or "rink" onto which balls are released toward target pins located part way down the surface. U.S. Design Pat. Nos. Des. 233,057 and Des. 238,891 show inverted generally conical game surfaces onto which balls or marbles are released, apparently to circle downward and exit though a central bottom hole.

In addition, applicant is the inventor of a large coin collecting device, including a generally conical surface with a coin guiding ramp, supported on a large free standing barrel-like base. Coins released on the ramp roll around the surface and drop into the base. Devices of this nature are relatively large and are intended for use as a novelty coin collecting device for charitable causes, being placed in retail stores, shopping malls, etc. along with appropriate signs describing the cause for which donations of coins are sought, and rewarding the donor (for example small children) by observing the long spiral path of the coins as they roll on edge toward a central hole in the surface and thence drop into the base. Such a device is shown in U.S. design application Ser. No. 821,300 filed 22 Jan. 1986.

SUMMARY OF THE INVENTION

The present invention provides a combined small coin bank and game, which is useful, appealing and enjoyable to persons of many ages. It may be used merely as a bank by very young children, who may also enjoy watching coins roll into its lower or collecting compartment. Persons of an age where they have sufficient strength and dexterity to lift and manipulate the device, as later described, can cause coins in particular to circle within the device for prolonged periods, and then to be allowed to diminish in velocity and roll into a collecting pedestal base.

The device comprises an open top main body having a vertically extending circular upper rim. The design and shape of the internal part of the rim is such as to retain coins circling therewithin, upon the outer edge of the main body of the device. The rim includes an outwardly extending lip, which functions to support a removable launching chute. Coins placed on the chute, when it is in place, will drop in a curving path along a ramp surface on the chute, and exit onto the interior of the main body, just inside the rim and moving in a tangential path to the main body surface.

The interior surface of the main body is formed circular, extending inward and downward from the rim with decreasing diameter around a vertical central axis, and terminating at its lower end in a circular opening through which coins or other round objects will fall when their momentum has decreased to the point that gravitational force on the coins exceeds centrifugal force resulting from their initial circular motion. The preferred shape of the interior surface of the main body is, in cross-section, a curve of increasing slope, whereby the intersection of the rim and body surface the slope is at an angle in the order of 120°, and at the discharge opening the surface is about vertical.

A pedestal base is attached to the main body, and comprises a generally flat bottom, preferably of circular configuration, and a circular upper end concentric with and of substantially lesser cross-sectional area than the bottom. The diameter of the base upper end is related to the diameter of the lower end of the main body. Preferably, these two parts have interfitting or telescoping portions, so the main body will be held in its upward facing position, with the rim in a level horizontal plane, when the base of the pedestal rests on a flat support such as a table top. The region where the pedestal and main body are joined is the location of the least cross-sectional dimension of the device, and the device can be grasped at this location, as between a thumb and forefinger of one hand, in the nature of a goblet, and maneuvered in a generally circular motion to impart centrifugal force to a coin or other rolling object located in the region of the rim. Thus, a person can generate sufficient force to keep the coin circling inside the rim, can decrease this force to allow the coin to following a dropping path toward the opening in the lower end of the main body, or can increase the force to bring the rolling coin along a path back upward toward the rim.

The device also includes a launching chute with one or more ramps configured thereon, removably mountable on the rim and curving upward and inward over the main body toward the vertical centerline of the main body and pedestal. The ramp surface extends downward and outward, with respect to the rim, and also along a curve which intersects the rim-body joint in a direction generally tangent to the rim. Thus, a coin rolling down the ramp surface will, just by dropping therealong, attain considerable velocity and move onto the upper edge of the main body surface, just inside the rim. The coin will circle inside the rim until its velocity decreases, and it will follow a downward spiral path of decreasing radius, unless the device is maneuvered, as mentioned above, to increase the velocity of the coin and the centrifugal force directing it in a path around the inside of the rim.

Other objects and advantages of the invention will be apparent from the following description, the accompanying drawings and the appended claims.

DESCRIPTION OF THE PREFERRED EMBODIMENT

Figure 4:
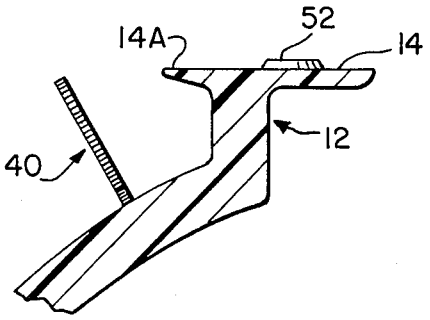
FIG. 4 is an enlarged partial cross-sectional view taken along line 4—4 in FIG. 3.
Figure 3:
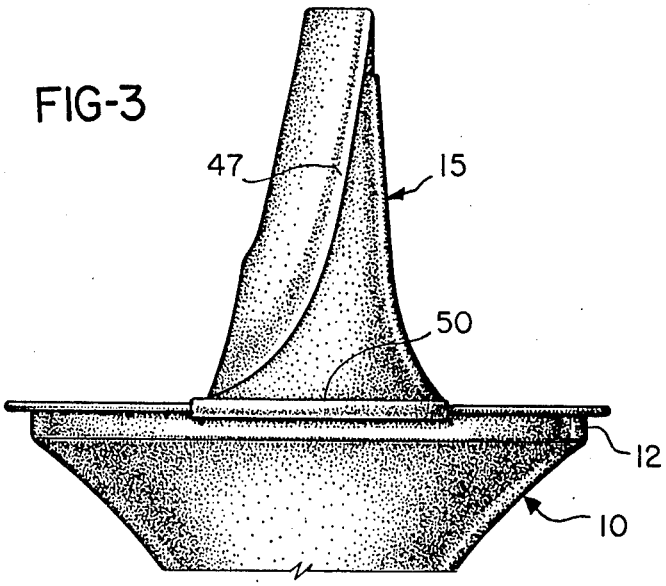
FIG. 3 is a partial side view of the device with the removable launching chute attached.
Figure 5:
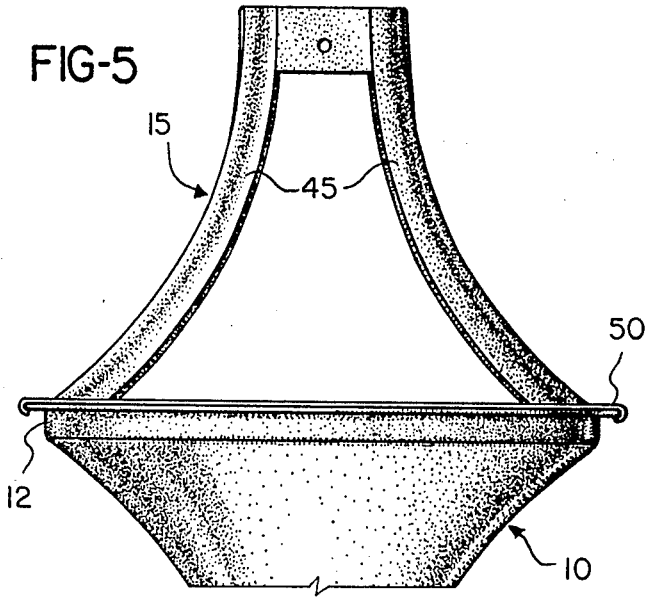
FIG. 5 is a partial rear view of the device.

The device comprises an open top main body 10 having a vertically extending circular upper rim 12 and including an outwardly extending lip 14 which functions to support a removable launching chute, indicated generally at 15. The interior surface 20 of main body 10 is formed circular, extending inward and downward from rim 12 with decreasing diameter around a vertical central axis 22, and terminating at its lower end 23 in a circular opening 24 through which coins or other round objects will fall when their momentum has decreased to the point that gravitational force on the coins exceeds centrifugal force resulting from their initial circular motion. The preferred shape of the interior surface 20 of main body 10 is, in cross-section, a curve of increasing slope, whereby the intersection of the rim and body surface is at an angle of about 120° (see FIG. 4), and at the discharge opening the slope is essentially an infinite number (i.e. the surface is vertical).

A pedestal base 30 is attached to main body 10, and comprises a generally flat bottom 32, preferably of circular configuration, and a circular upper end 33 concentric with and of substantially lesser cross-sectional area than the bottom. The bottom is covered by a removable snap-on cap 34, thus providing a collecting chamber within the base. The diameter of the base upper end 33 is related to the diameter of the lower end 23 of the main body. Preferably, these two parts have interfitting or telescoping portions 35, so the main body will be held in its upward facing position, with rim 12 in a level horizontal plane, when the bottom 32 of the pedestal rests on a flat support such as a table top.

The region where the pedestal and main body are joined is the location of the least cross-sectional dimension of the device, in the nature of a stem, and the device can be grasped at this location, as between a thumb and forefinger of one hand, in the nature of a goblet, and maneuvered in a generally circular motion to impart centrifugal force to a coin 40 or other rolling object located in the region of rim 12. Thus, a person can generate sufficient force to keep the coin circling inside the rim, can decrease this force to allow the coin to follow a dropping path toward the opening in the lower end of the main body, or can increase the force to bring the rolling coin along a path back upward toward the rim.

Figure 1:
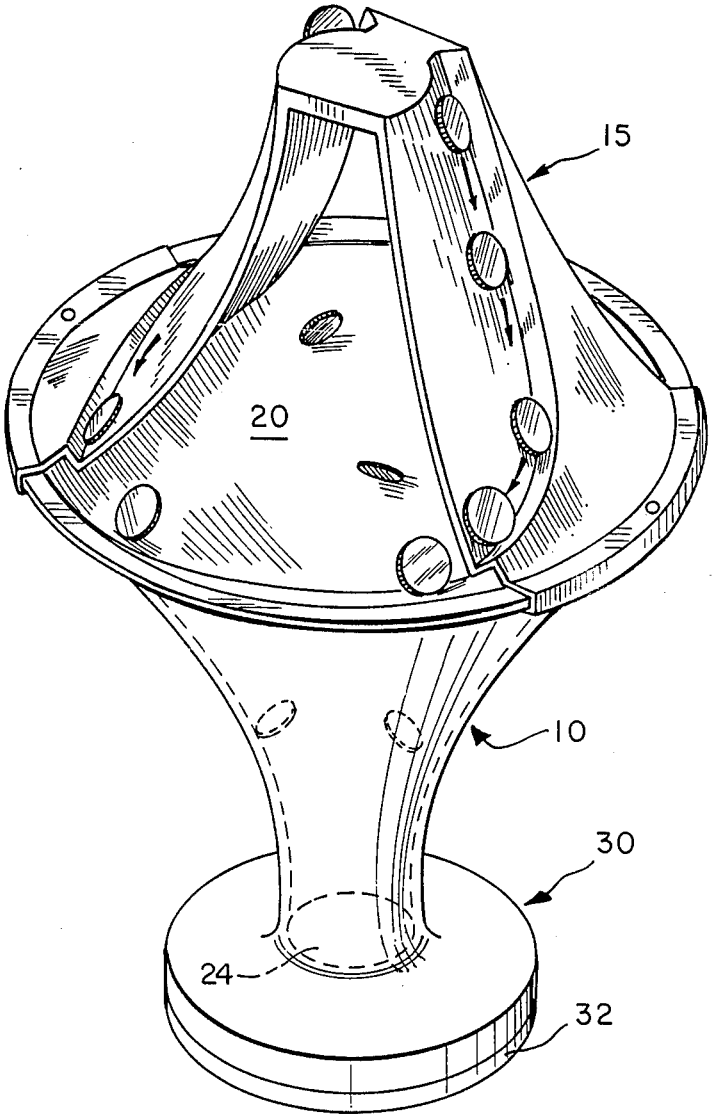
FIG. 1 is a perspective view of a device for collecting and playing with small round objects such as coins or disks, including a removable dual launching chute for optional use in directing objects generally tangentially onto the inverted conical surface of the main body.
Figure 2:
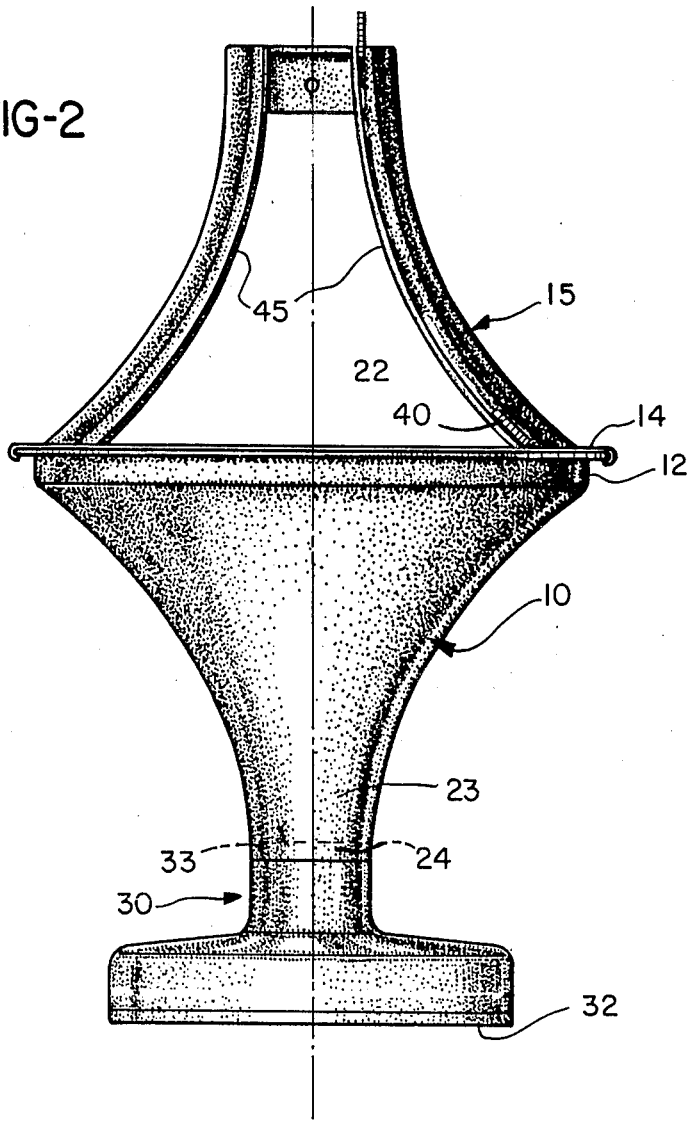
FIG. 2 is a front view of the device.

The device also includes a launching chute 15, comprising two symmetrical contoured arms 45 with ramps 47 configured thereon, and removably mountable on the rim and curving upward and inward over the main body toward the vertical centerline of the main body and pedestal as seen in FIGS. 1 and 2. The ramps extend downward and outward, with respect to the rim, and also along a curve which intersects the rim-body joint in a direction generally tangent to the rim. A coin 40 placed on the chute, will drop in a curving path along a ramp 47 and exit onto the surface 20 of the main body, just inside the rim and moving in a generally tangential path to the main body surface. Thus, a coin rolling down the ramp surface will, just by dropping therealong, attain considerable velocity and move onto the upper edge of the main body surface, just inside the rim. The coin will circle inside the rim until its velocity decreases, and then will follow a downward spiral path of decreasing radius, unless the device is maneuvered (as mentioned above) to increase the velocity of the coin and the centrifugal force, directing it in a path around the inside of the rim.

It will be apparent that the main body-pedestal combination is usefull without launching chute 15, to the extent that a person can simply rest a coin against the rim 12, tilting the body, and then maneuver the device in a circular motion to accelerate the coin and cause it to roll at considerable speed about the inside of rim 12. In fact, with some practice it is possible to achieve a condition where centrifugal forces on the rolling coin will urge it against the rim even while the device is substantially inverted. To that end, the rim may be provided with a slight inward slanted lip 14A (FIG. 4) which forms a small curl-like edge at the upper end of rim 12. The rolling coin can travel around this edge, with the coin rolling approximately normal to the main body surface at this location (see FIG. 4) to keep it within the rim even during such out-of-level maneuvers.

Figure 6:
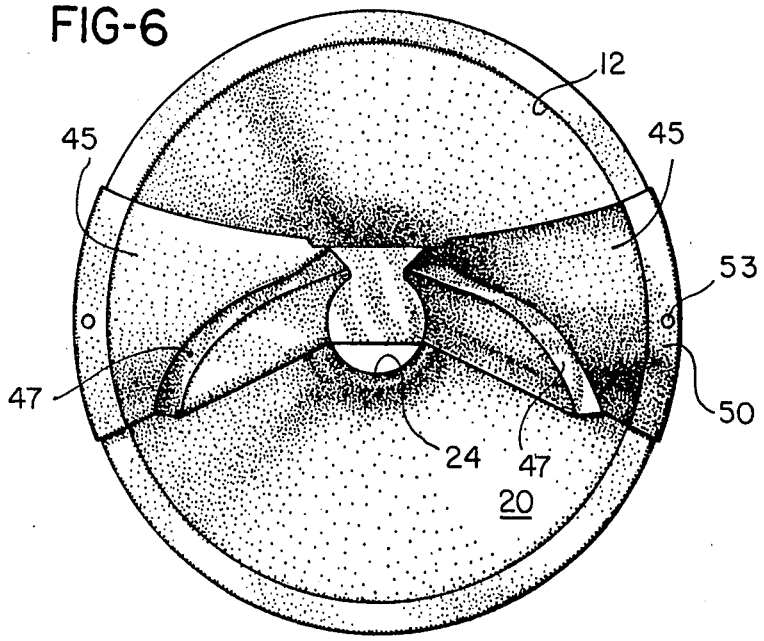
FIG. 6 is a plan view of the launching chute and the inverted conical surface of the device.
Figure 7:
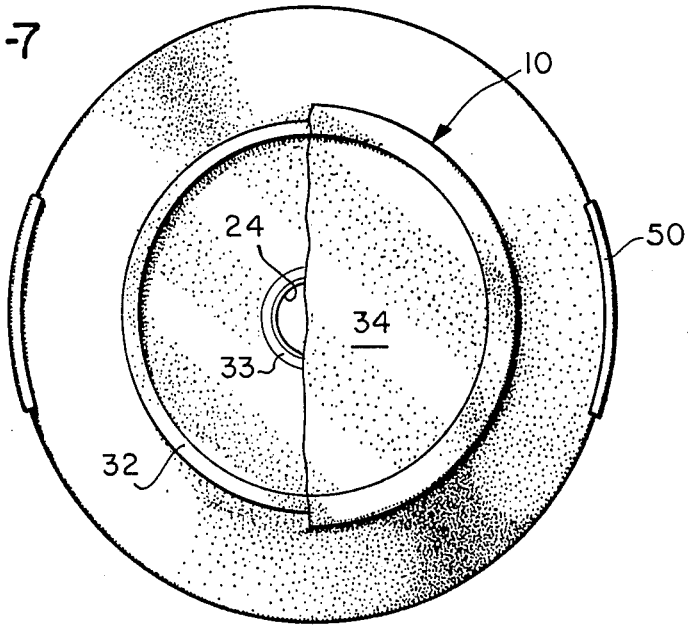
FIG. 7 is a bottom view thereof, with the bottom cover partially broken away to show the interior of the pedestal base of the device.

The chute member 15 is attached to the main body 10 by the pressing action of a pair of partial rim members 50 which extend from the ends of arms 40 and fit around rim 12, as shown particularly in FIGS. 2, 6, and 7. A small dimple 52 on the upper surface of rim 12 extends into a depression or hole 53 in each of members 50, providing a locating or orienting means to resist rotational movement of the chute 15 about rim 12. The clamping or holding action of the members 50 is achieved simply by constructing them spaced apart slightly less than the diameter of lip 14, such that slight separating force is needed to fit the chute member around rim 12, resulting in pressing of the members 50 against lip 14.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A device for collecting and/or playing with small disc-like objects such as coins, comprising a base including a hollow pedestal having a generally flat bottom and a circular upper end concentric with and of substantially lesser cross-sectional area than said bottom, an open top main body having a vertically extending circular upper rim portion and circular surface portion extending from said rim portion downward and inward to a lower aperture concentric with said rim and merging with said upper end of said pedestal whereby said main body is supported on said pedestal along a common vertical centerline, said main body having a shape in cross-section which is a curve of increasing slope from top to bottom, said rim portion having a diameter no greater than approximately twice the width of said bottom of said pedestal, whereby the device can be grasped near the juncture of said main body and said upper end of said pedestal to maneuver the same and cause disc-like objects to travel around the inside of said rim or to roll through a spiral path of decreasing radius into the lower aperture of said body and thence to drop into said base.

2. A device as defined in claim 1, further including a launching ramp mountable on said rim and curving upward and inward over said main body toward the vertical centerline of said main body and said pedestal, said ramp including a downwardly and outwardly formed guiding surface which is located along a curve extending downward toward said rim and intersecting said rim approximately along a tangent thereto and arranged to cause disc-like objects placed thereon to roll down said ramp and onto the surface of said main body inside and along said rim.

3. A device for collecting and/or playing with small disc-like objects such as coins, comprising a base including a pedestal having a generally flat bottom and a circular upper end concentric with and of substantially lesser cross-sectional area than said bottom, an open top main body having a vertically extending circular upper rim portion and a circular surface portion extending from said rim portion downward and inward to a lower aperture concentric with said rim and merging with said upper end of said pedestal whereby said main body is supported on said pedestal along a common vertical centerline, said rim portion having a diameter no greater than approximately twice the width of said bottom of said pedestal, a launching ramp mounted on said rim and extending upward and inward over said main body toward the vertical centerline of said main body and said pedestal, said ramp including a downwardly and outwardly formed guiding surface which is located along a curve extending downward toward said rim and intersecting said rim approximately along a tangent thereto and arranged to cause disc-like objects placed thereon to roll down said ramp, onto the surface of said main body inside said rim, and through a helical path of decreasing radius into said aperture.

4. A device as defined in claim 3, wherein said ramp is curved upward and inward in a shape which is approximately the inverse of the shape of said main body.

5. A device as defined in claim 3, wherein said main body intersects said rim at an angle of approximately 120° whereby disc-like objects circling within said rim will tend to assume an angular attitude tipping inward toward the centerline.

* * * * *